US007825756B2

(12) United States Patent
Takeda

(10) Patent No.: US 7,825,756 B2
(45) Date of Patent: Nov. 2, 2010

(54) ELECTRO-MAGNETIC RELAY

(75) Inventor: Hideaki Takeda, Misato (JP)

(73) Assignee: Uchiya Thermostat Co., Ltd. (JP)

( * ) Notice: Subject to any disclaimer, the term of this patent is extended or adjusted under 35 U.S.C. 154(b) by 244 days.

(21) Appl. No.: 12/106,062

(22) Filed: Apr. 18, 2008

(65) Prior Publication Data

US 2008/0303616 A1 Dec. 11, 2008

(30) Foreign Application Priority Data

Jun. 8, 2007 (JP) ..... 2007-152332

(51) Int. Cl.
*H01H 51/22* (2006.01)

(52) U.S. Cl. ..... 335/78; 335/124; 335/128

(58) Field of Classification Search ..... 335/78–86, 335/124, 128–131, 202
See application file for complete search history.

(56) References Cited

U.S. PATENT DOCUMENTS 5,844,456 A * 12/1998 Mader ..... 335/78
6,674,197 B2 * 1/2004 Iwabuchi et al. ..... 310/81
7,061,350 B2 * 6/2006 Schneider et al. ..... 335/78
7,187,257 B2 * 3/2007 Mochizuki et al. ..... 335/78
2002/0196111 A1 * 12/2002 Shinoura et al. ..... 335/78
2005/0264386 A1 12/2005 Chida et al.

FOREIGN PATENT DOCUMENTS

JP 2005340062 12/2005

* cited by examiner

*Primary Examiner*—Elvin G Enad
*Assistant Examiner*—Bernard Rojas
(74) *Attorney, Agent, or Firm*—Schwegman, Lundberg & Woessner, P.A.

(57) ABSTRACT

The electro-magnetic relay comprises a contact block which is structured to uniformly maintain the contact resistance between the terminals of two circuits. Fixed contacts are provided for each of the terminals of the two circuits and each of two sets of a pair of movable contacts in positions corresponding to these is supported by two both-end-supported movable springs. An insulation sheet and a press spring are overlapped over the two movable springs and disposed as a bridge. A pair of tongues are formed on the press spring by a Z-character shaped cut and by an armature pressing their tips, the insulation sheet and press spring transforms to an upward concave shape, the two movable springs bend and are taken in inside while inclining and the movable contacts touch the fixed contacts while sliding.

4 Claims, 12 Drawing Sheets

ELECTRO-MAGNETIC RELAY

CROSS REFERENCE TO RELATED APPLICATION

This application is based upon and claims the benefit of priority from the prior Japanese Patent Application No. 2007-152332, filed on Jun. 8, 2007, the entire contents of which are incorporated herein by reference.

BACKGROUND OF THE INVENTION

1. Field of the Invention

The present invention relays to an electro-magnetic relay structured to simultaneously open/close two circuits with uniform contact contact force.

2. Description of the Related Art

Traditionally, a small electro-magnetic relay capable of controlling two circuits, with large electricity capacity, high cut-off performance and superior anti-shock/vibration characteristic is known.

For example, an electro-magnetic relay in which an armature tip presses the center of a card block being a member bridging these circuits and the driving force of the armature is conveyed to movable contacts via the card block when driving the contacts of two parallel circuits is proposed.

Specifically, in this electro-magnetic relay, it is designed in such a way that force concentrated to one point of the armature tip or a narrow area close to one point can be distributed in two directions via the card block to drive two circuits (see, for example, the abstract and FIG. 2 of Patent Document 1: Japanese Patent Application No. 2005-340062).

When the force concentrated to one point is uniformly distributed in two directions as described above, the contact contact force (so called "contact pressure") of the two circuits becomes uniform and its contact resistance also becomes the same as a rule. Therefore, there is no problem.

However, when the above is experimented using the structure of the electro-magnetic relay of Patent Document 1, it is found that the uniformity of the contact pressure is broken due to positional deviation and the like and the contact resistance is easy to become uneven, since the point pressed by an armature (power point) is above a contact contact part (action point).

SUMMARY OF THE INVENTION

The electro-magnetic relay of the present invention is provided with a contact block structured to be able to maintain the contact resistance between the terminals of two circuits uniform. This electro-magnetic relay comprises an electro-magnetic drive block composed of at least a coil, an iron core, a yoke and an armature, a contact block composed of a base, two sets of a pair of terminals provided in parallel, corresponding to two circuits fixed on the base, spherical fixed contacts provided at one end of the terminals, two both-end-supported movable springs and a plane movable contact disposed in positions corresponding to the fixed contacts provided on the movable springs, an insulation sheet disposed on the top surface of the two movable springs and a press spring disposed on the top surface of the insulation sheet, each of the longitudinal both-end sides of which is disposed above the two movable springs, the center of which is cut in the shape of a character Z to form a pair of tongues and each tip of the pair of the tongues of which is disposed in the middle of the two movable springs. It is structured in such a way that the armature can drive the movable springs via the tip of the pair of tongues of the press spring, the root of the tongues, the longitudinal both-end sides of the press spring and the insulation sheet to open/close the contact circuit.

In this electro-magnetic relay, a guide concavity in such a shape as to receive the tip of the armature, for example, when the tip of the armature moves to drive the movable springs is formed at the tip of the tongues of the press spring.

In this electro-magnetic relay, for example, the press spring comprises a both-side joint the width of which is narrower than that of the tongues at an end in the further outside than the tongues in the sort hand direction. It is structured in such a way that the both-side joint of the press spring bends in an upward concave shape, each of the longitudinal both-end sides of the press spring forms inclination from outside to inside, each of the two movable springs forms inclination downward the inside in the short side direction along the inclination of the longitudinal both-end sides of the press spring and the movable contacts move toward the inside of the two movable springs from the peak position of the spherical surface of the fixed contacts along the inclination downward the inside in the short side direction of the two movable springs when the armature presses the tongues to touch the movable contacts on the fixed contacts.

In this electro-magnetic relay, for example, the insulation sheet comprises a plurality of long cuts in a direction orthogonal to the longitudinal direction of the two movable springs. It is structured in such a way that of the plurality of cuts, two cuts are provided in a position corresponding to the both-side joint of the press spring, the tongues of the press spring are formed in a position one step higher than the both-side joint by an upward crank curve formed on the root and when the press spring is disposed on the top surface of the insulation sheet, such space sufficient as to prevent the press spring from being interfered by the insulation sheet is formed.

For example, the longitudinal both-ends of the insulation sheet are formed at least longer in the inside than the root of the tongues of the press spring and longer in the outside than the longitudinal both-ends of the press spring.

According to the present invention, since both pressing driving force of an armature is distributed to two both-end supported conductive movable springs for supporting the movable contacts of two circuits via the center of a pair of tongues formed at the center of a press spring to simultaneously open/close with uniform force and also at the time of contact the movable contact touches a fixed contact while wiping, an electro-magnetic relay for driving two circuits with the same always stable contact contact force, that is, internal resistance can be provided.

DESCRIPTION OF THE PREFERRED EMBODIMENTS

The preferred embodiments of the present invention are described below with reference to the drawings.

The First Preferred Embodiment

Figure 1A:
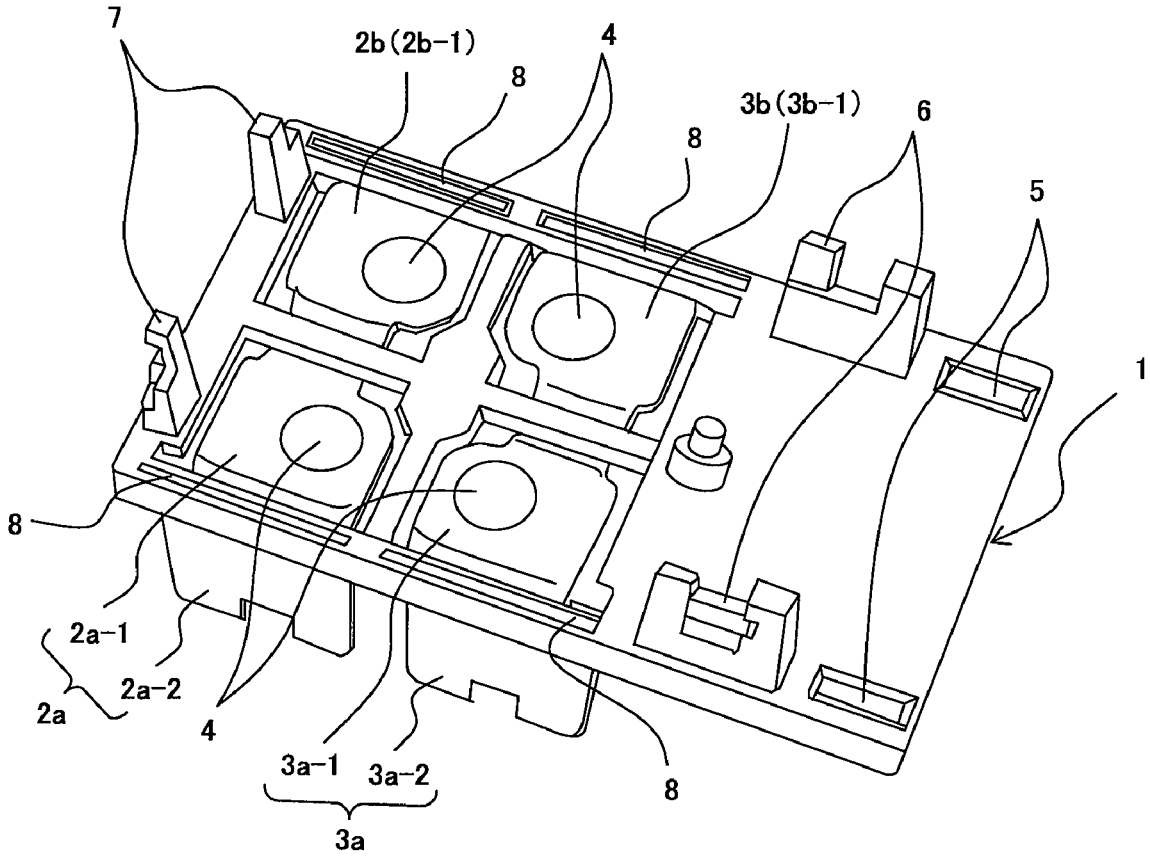
FIG. 1A is the perspective view showing the assembled state of a base and terminals at the time of the assembly of the contact block of the electro-magnetic relay in the first preferred embodiment.
Figure 1B:
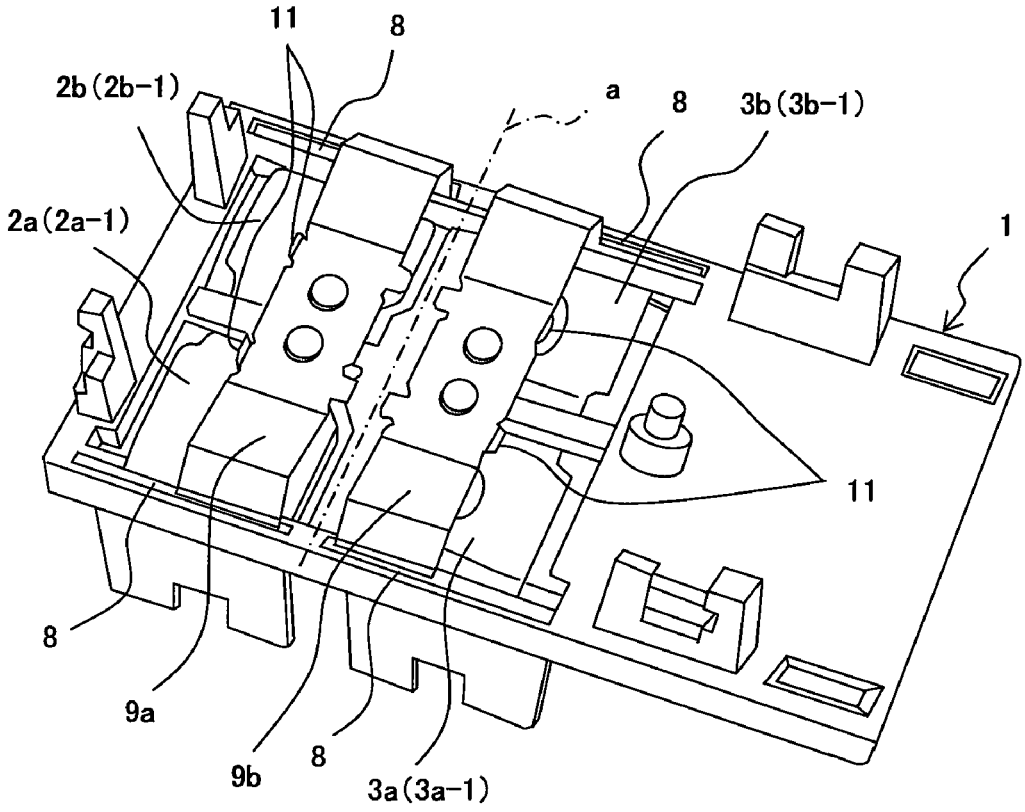
FIG. 1B is a perspective view showing the assembled state of movable springs after the assembly of the base and terminals of the contact block of the electro-magnetic relay in the first preferred embodiment.

FIGS. 1A and 1B show the first assembly process of the contact block of the electro-magnetic relay in the first preferred embodiment.

As shown in FIG. 1A, this contact block comprises a base 1 and two sets of a pair of a terminal 2 (2*a* or 2*b*) and a terminal (3*a* or 3*b*) corresponding to two external circuits fixed on this base 1, which are provided in parallel.

These pairs of terminals 2 and 3 are fixed on the base 1 by inserting the bent part of each of terminals 2*a* (2*a*-1 and 2*a*-2), 2*b* (2*b*-1 and 2*b*-2, which is not shown in FIG. 1), 3*a* (3*a*-1 and 3*a*-2) and 3*b* (3*b*-1 and 3*b*-2, which is not shown in FIG. 1), which are bent in the shape of a character "L", in the long holes of the base 1.

The L-shape bent terminals 2*a*, 2*b*, 3*a* and 3*b* constitute internal terminals 2*a*-1, 2*b*-1, 3*a*-1 and 3*b*-1, which are disposed on the top surface and external terminals 2*a*-2, 2*b*-2, 3*a*-2 and 3*b*-2, which are provided upright on the outer bottom surface of the base 1 and are connected to external circuits.

By bending terminals in a L-character shape to form an internal and external terminals, two sets of a pair of terminals 2*a* and 2*b* and a pair of terminals 3*a* and 3*b*, which are provided in the internal terminals are closely disposed.

Then, a fixed contact 4 whose surface is spherical is fixed and disposed on each of the internal terminals 2*a*-1, 2*b*-1, 3*a*-1 and 3*b*-1 which are disposed on the top surface of the base 1, specifically one terminal of a pair of terminals 2 and 3.

In the base 1, a coil terminal through hole 5 through which the coil terminal of the electro-magnetic drive block, which is described later, is inserted is formed at each longitudinal terminal end opposite to the position where the two sets of a pair of terminals 2 and 3 are disposed.

In the base 1, a yoke back joint guide 6 which is fit into the yoke back end of the electro-magnetic drive block, which is also described later, is provided upright in the middle between the coil terminal through hole 5 and the two sets of a pair of terminals 2 and 3.

Furthermore, a yoke front joint 7 which is fit into the yoke front end of the electro-magnetic drive block (on a side where an armature described later and a core touches and separates) is provided upright in the vicinity of both ends of the longitudinal terminal on a side where the two sets of a pair of terminals 2 and 3 of the base 1 are disposed.

Furthermore, in the base 1, a movable spring insertion groove 8 which is insulated from a terminal is formed in each of its outside along the long hole which the bent part of the L-shaped terminals 2 and 3 inserted in and fixed on.

As shown in FIG. 1B, each tip of the both ends which are bent at a right angle against the center, of two both-end supported springs 9 are vertically fit into and fixed on these movable spring insertion grooves 8.

Each of these two movable spring 9 is disposed bridging a pair of the fixed contact 4, and a plane movable contact is fixed and provided in a position corresponding to each fixed contact 4 of their bottom surfaces, which is not shown in FIG. 1.

The center of this movable spring 9 on which the movable contact is fixed and provided is formed in such a way as to freely move vertically, and a fairly large curve is provided in the bent parts of the both ends which are bent at a right angle against the center of the movable spring 9 in such a way that sufficient separation force from the fixed contact 4 can be obtained from the spring operation when the movable contact is released from pressure to the fixed contact 4.

For example, in the case of always OFF contact structure (contact a), its contact gap is set in a state where the movable spring 9 with a movable contact is fixed ob the base 1 and the center of the movable spring 9 is pressed down. Thus, the reaction force of a spring obtained when closing its contact can be set as the separation force of the contact.

In this way, when two movable contacts and two fixed contacts 4 are bridged by one movable spring 9 and connected (the contacts are closed), each of two circuits composed of terminals 2 and 3 is energized in the order of one external terminal (for example, 2*a*-2), its internal terminal (2*a*-1), its fixed contacts 4, the above-described bridge mechanism (two movable contacts and one movable spring 9), the other contacts 4, its internal terminal (2*b*-1) and its external terminal (2*b*-2) and as shown in the above-described structure, the internal circuit from one terminal to the other terminal takes the shortest route. Thus, the low circuit resistance can be realized.

In the above structure, it is naturally preferable for the movable spring 9 to have high conductivity. However, as described later, when movable contacts are mounted on a movable plate having high conductivity and this movable plate is supported by a movable spring 9, the movable spring 9 can be also a member with high resistance or a non-conductive member.

The boundary of an intermediate part, indicated by a one-point chain line "a" shown in FIG. 1 is provided between the above-described two movable springs 9*a* and 9*b*, and the two movable springs 9*a* and 9*b* are a little separated and disposed with their respective longitudinal directions in parallel with the boundary.

Then, in the two movable springs 9*a* and 9*b*, two insulation sheet restricting nails 11 are provided upright at each outer end opposite to the boundary of the intermediate part.

Figure 2A:
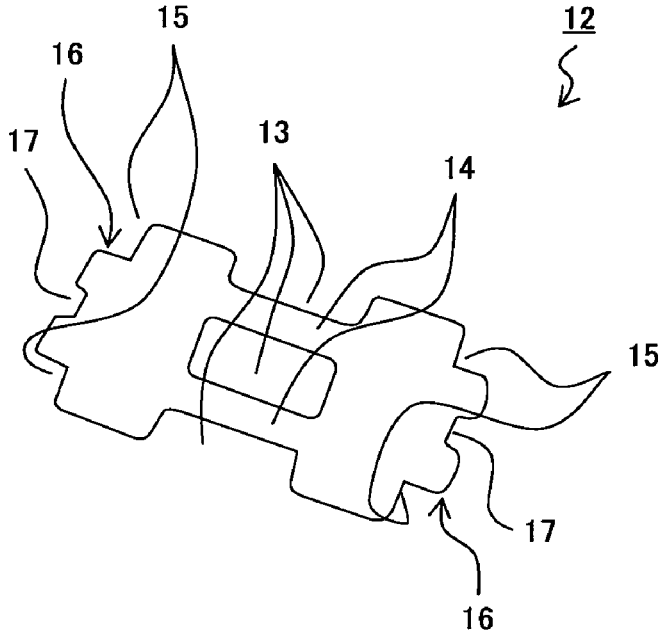
FIG. 2A is a perspective view showing an insulation sheet disposed and used on the top surface of the two movable springs of the contact block of the electro-magnetic relay in the first preferred embodiment.
Figure 2B:
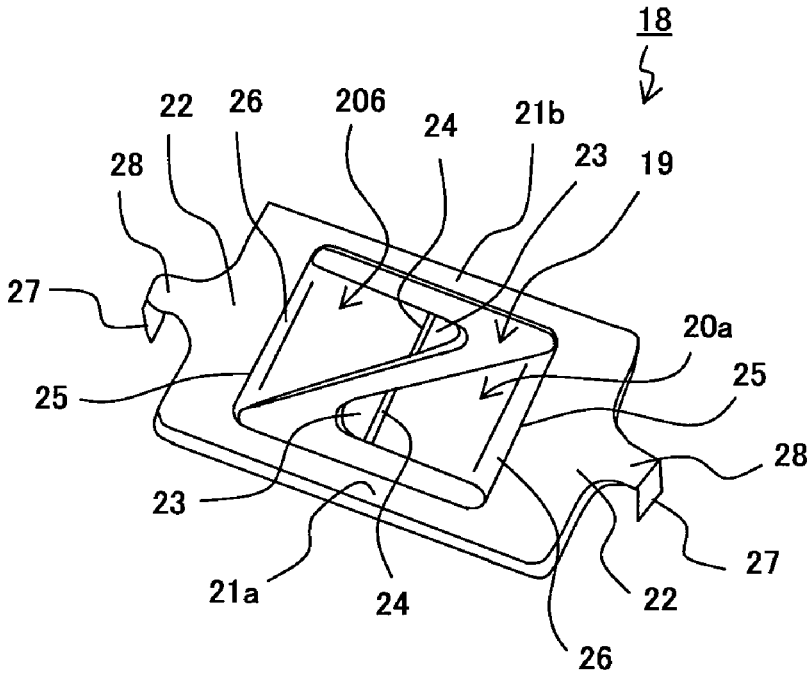
FIG. 2B is a perspective view showing a press spring disposed and used on the top surface of the insulation sheet of the contact block of the electro-magnetic relay in the first preferred embodiment.

FIG. 2A is the perspective view of an insulation sheet disposed and used on the top surface of the two movable springs 9. FIG. 2B is the perspective view showing a press spring disposed and used on the top surface of the insulation sheet.

The insulation sheer 12 shown in FIG. 2A is made of a heat-resistant insulation sheet, such as polyimide sheet or the like. In the insulation sheet 12, long cuts 13 in parallel in the longitudinal direction are formed at the center an each end. Two long sheets left between these long cuts 13 formed at the center and at each end form two joints 14 for connecting the longitudinal both-ends of the insulation sheet 12.

The outer both angles of the longitudinal both-ends of this insulation sheet are cut nearly at a right angle and the cuts form a position restricted part 15 by which its position against the movable spring 9 is restricted as shown later.

A fitting cut concavity 17 which is fit into the press spring 18 shown in FIG. 2B is formed at the outer end center of a projection 16 left in the outer direction at the end center by the above-described cut.

The press spring 18 shown in FIG. 2B is disposed on the top surface of the above-described insulation sheet 12. The center of this press spring 18 is cut in the shape of a character "Z" to form a Z-shaped cut 19 and the remaining part at the center forms a pair of tongues 20 (20*a* and 20*b*).

Both-end joints 21 (21*a* and 21*b*) which are narrower than the tongues 20 are formed at an end which is positioned in the further outside than the tongues 20 in the short side direction of this press spring 18. Since the plate width increases toward the longitudinal both ends 22 of the press spring 18, the tongues 20 and the longitudinal both ends 22 have little deflection.

However, since the width of the both-end joints 21 which connects the longitudinal both ends 22 is narrower than that of the tongues 20, specifically, becomes the narrowest and longest, the entire press spring 18, the both-end joints 21 are easiest to deflect.

Therefore, when the tips 23 of the tongues 20 are transformed to sink in the center by being pressed down and the tongues 20 is inclined with the tip downward, the longitudinal both ends 22 also transforms together with the tongues 20 with its outside raised upward since the tongues 20 deflects little.

Thus, the tongues 20 and the longitudinal both ends 22 deflect little and almost only the both-end joints 21 deflects in an upward concave shape.

A guide concavity 24 is formed at the tips 23 of the tongues 20. This guide concavity 24 is structured in such a way as to receive the tip of the armature described later of the electromagnetic block when guide concavity 24 moves to press and drive the movable spring 9.

A crank curve 26 which rises upward is formed at the root 25 of the tongues 20. Thus, the entire tongues 20 are disposed in a position one step higher than the both-end joints 21.

Then, a projection 28 with a joint nail 27 which is bent downward almost at a right angle is formed in each of the above-described longitudinal both ends 22 of the press spring 18.

Figure 3A:
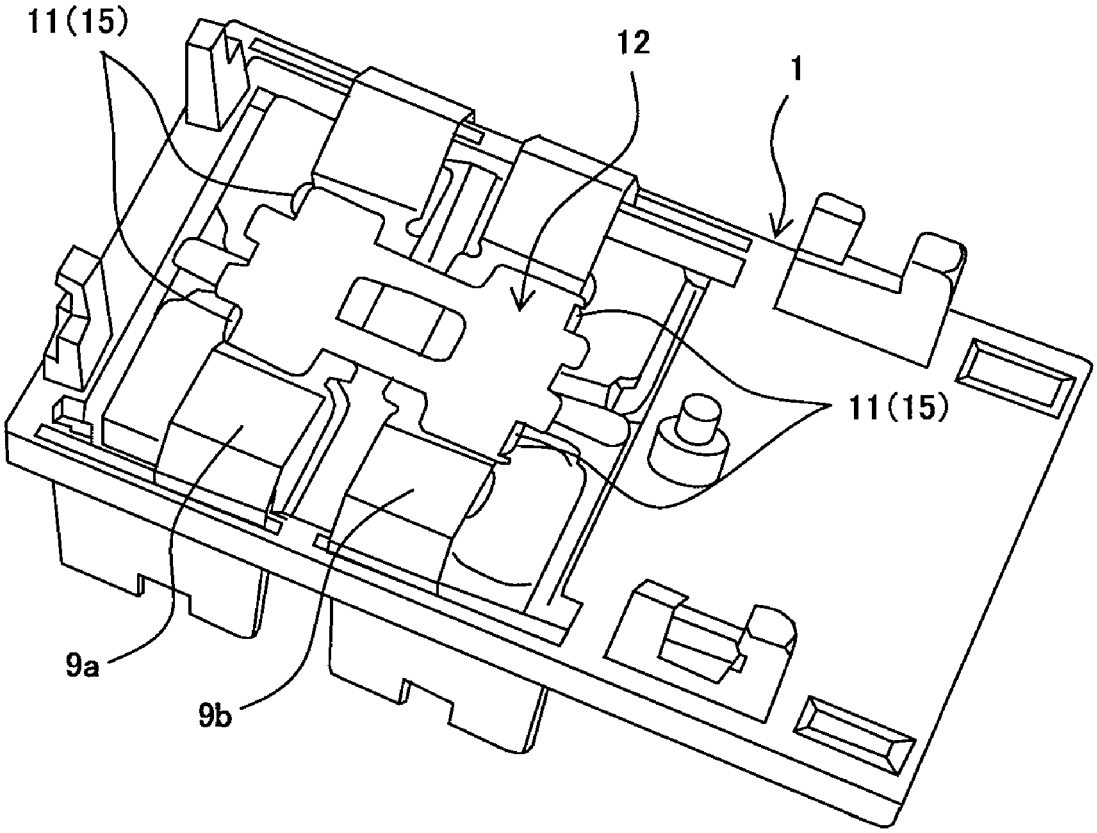
FIG. 3A is a perspective view showing a state where the insulation sheet is disposed on the top surface of the two movable springs in the contact block of the electro-magnetic relay in the first preferred embodiment.
Figure 3B:
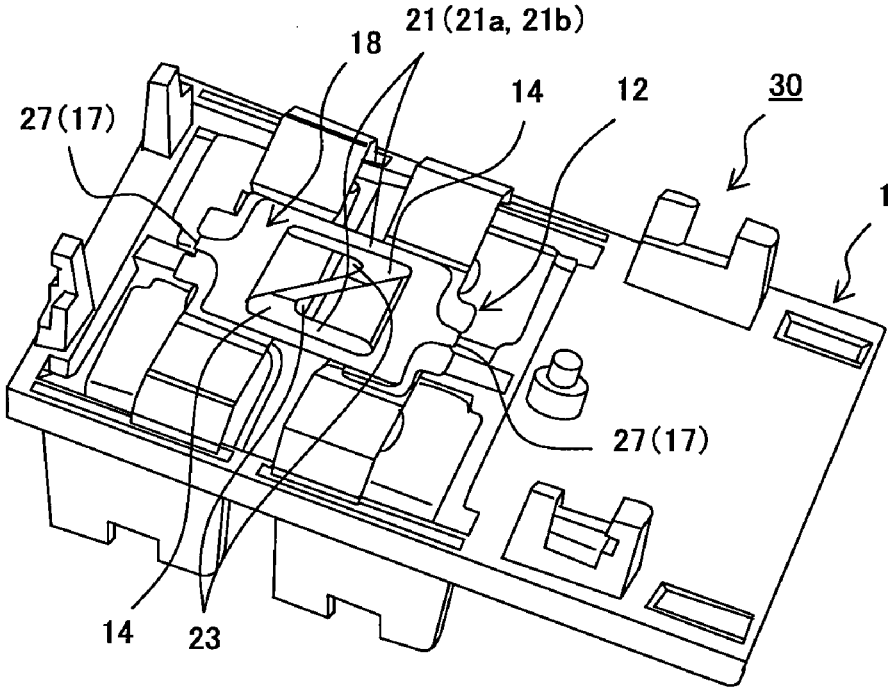
FIG. 3B is a perspective view showing a state where the press spring is disposed on the top surface of the insulation sheet in the contact block of the electro-magnetic relay in the first preferred embodiment.

FIG. 3A is a perspective view showing a state where the above-described insulation sheet 12 is disposed on the top surface of the two movable springs 9*a* and 9*b*. FIG. 3B is a perspective view showing a state where the press spring 18 is disposed on the top surface of the insulation sheet 12.

In this state, the plurality of long cuts 13 shown in FIG. 2A of the insulation sheet 12 is disposed in a direction orthogonal to the longitudinal direction of the two movable springs 9.

The insulation sheet restricting nails 11 of the movable springs 9*a* and 9*b* are fit into the position restricted parts 15 in the four corners shown in FIG. 2A of the insulation sheet 12. By these insulation restricting nails 11, the position of the insulation sheet 12 is prevented from greatly deviating from the movable springs 9*a* and 9*b*.

As shown in FIG. 3B, the press spring is disposed on the top surface of this insulation sheet 12. In this state, the joint nail 27 shown in FIG. 2B of the press spring 18 is fit into the fitting cut concavity 17 of the projection 16 shown in FIG. 2A of the insulation sheet 12.

By this fitting cut concavity 17 the press spring 18 is prevented from being greatly deviated from the movable springs 9*a* and 9*b* via the insulation sheet 12.

In this state, two side cuts 13 of the plurality of (three in this example) of cuts 13 of the insulation sheet 12 shown in FIG. 2A are disposed in positions corresponding to the both-end joints 21 (21*a* and 21*b*) of the press spring 18.

Thus, as described in FIG. 2B, it is structured in such a way that in the operation of this electro-magnetic relay, which is described later, when the both-end joints 21 deflect in an upward concave shape (that is, in a downward convex shape), this deflecting operation may not be prevented.

Since as described above (see FIG. 2B), the tongues 20 of the press spring 18 are disposed in positions one step higher than the both-end joints 21 by the upward rising crank curve 26 formed on the root 25, as shown in FIG. 3B, the tongues 20 of the press spring 18 (therefore also the tip 23) is disposed in sufficient space not to be interfered by the insulation sheet 12 when the press spring 18 is disposed on the top surface of the insulation sheet 12.

Thus, it is structured in such a way that it may not prevented by the insulation sheet 12 even when the armature presses down the tips 23 of the tongues 20.

In FIG. 3B, the longitudinal both ends 22 shown in FIG. 2A of the insulation sheet 12 is formed at least longer inside than the root 25 of the tongues 20 of the press spring 18 and longer outside than the longitudinal both ends 22 of the press spring 18.

If the positions of the cuts 13 change, one longitudinal end is positioned in the further outside of the press spring 18 than one crank curve 26 (see FIG. 2) of the tongues 20 and the other (opposite) longitudinal end is positioned in the further inside of the press spring 18 than the other crank curve 26, the bent state of the insulation sheet 12 and the reaction point of armature force become easily imbalanced and the respective contact pressure and resistance of the contacts of two circuits easily differs.

If the longitudinal both ends 22 of the insulation sheet 12 are longer inside than the root 25 of the tongues 20 of the press spring 18, specifically, the longitudinal end of the cut 13 is positioned further inside than the crank curve 26, even when the position somewhat deviates, the pressing-down of the armature is hard to be imbalanced, force can be stably distributed and the contact pressure and resistance of each contact can be uniformly maintained.

In this way, the base 1, the terminals 2 and 3 with four fixed contacts, the two movable springs 9, the insulation sheet 12 and the press spring 18 are completely assembled to complete the contact block 30 as shown in FIG. 3.

Figure 4A:
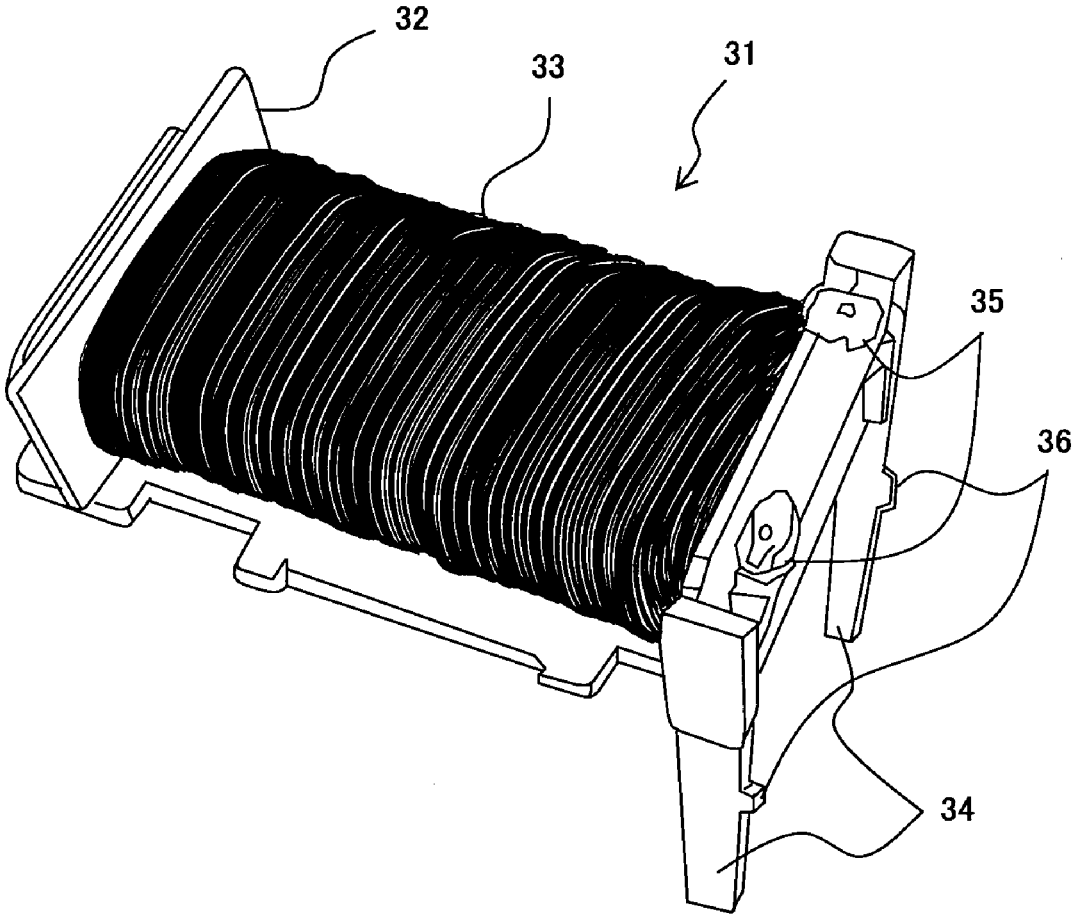
FIG. 4A is a top perspective view showing an electro-magnetic drive block assembled into the contact block of the electro-magnetic relay in the first preferred embodiment.
Figure 4B:
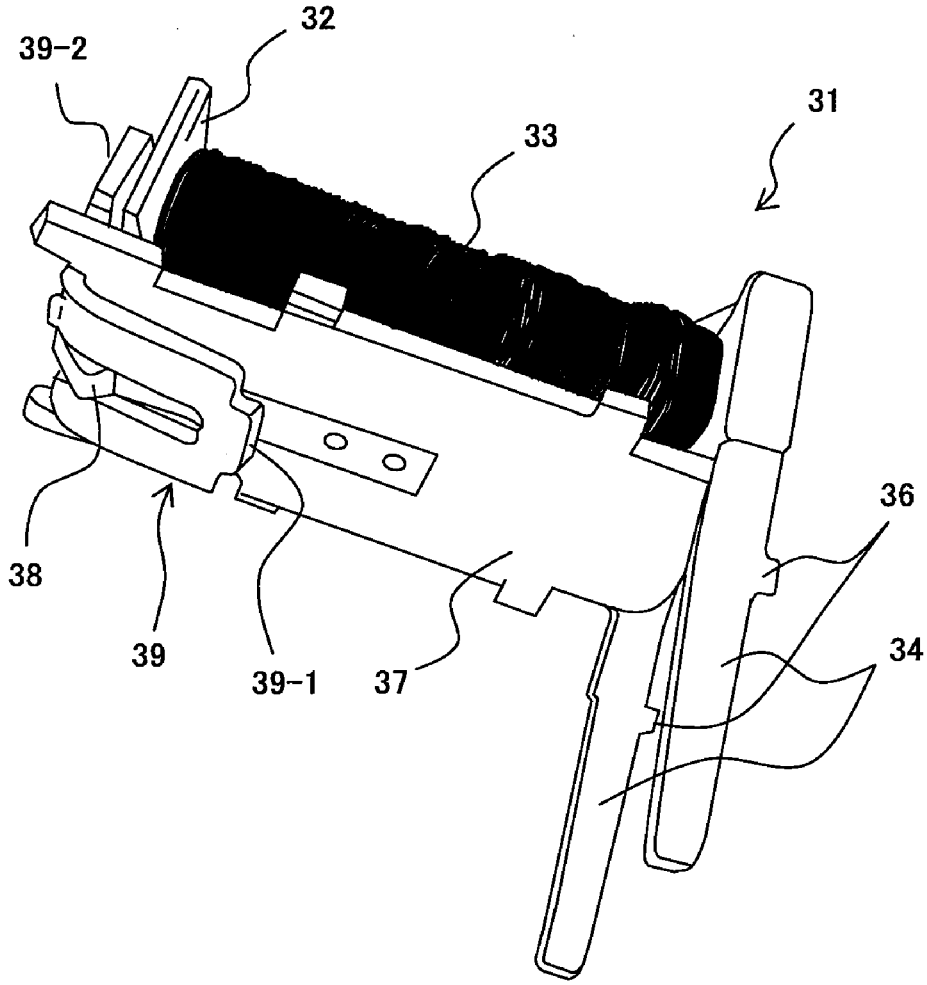
FIG. 4B is a bottom perspective view showing the electro-magnetic drive block shown in FIG. 4A.

FIG. 4A is a top perspective view showing the electromagnetic drive block assembled into the above-described contact block. FIG. 4B is its bottom perspective view. The electro-magnetic drive block shown in FIGS. 4A and 4B is of general hinge type.

As shown in FIG. 4A, the electro-magnetic drive block 31 comprises a coil bobbin 32, a coil 33 wound around this coil bobbin 32, two coil terminals 34 fixed on the coil bobbin 32 and a joint 35 in which these two coil terminals 34 and both ends of the coil 33 are connected by soldering.

A convexity 36 is formed outward in each of the two coil terminals 34. An iron core, which is not shown in FIG. 4A, is inserted and disposed inside the coil 33.

As shown in FIG. 4B, in the electro-magnetic drive block, a yoke 37 is disposed underneath the bottom of the coil 33. The yoke 37 is fixed on and supported by the coil bobbin 32. an armature 39 is mounted on this yoke 37 via a hinge spring 38. The curve bent almost at a right angle, of this armature 39 is supported by the hinge spring 38.

This armature is positioned on the right side of the coil bobbin 32 in FIG. 4B and comprises an absorbed/separated part 39-2 opposite to the iron core and a vertical drive unit 39-1 which is placed around below the yoke 37 from the curve and disposed below the yoke 37.

Figure 5:
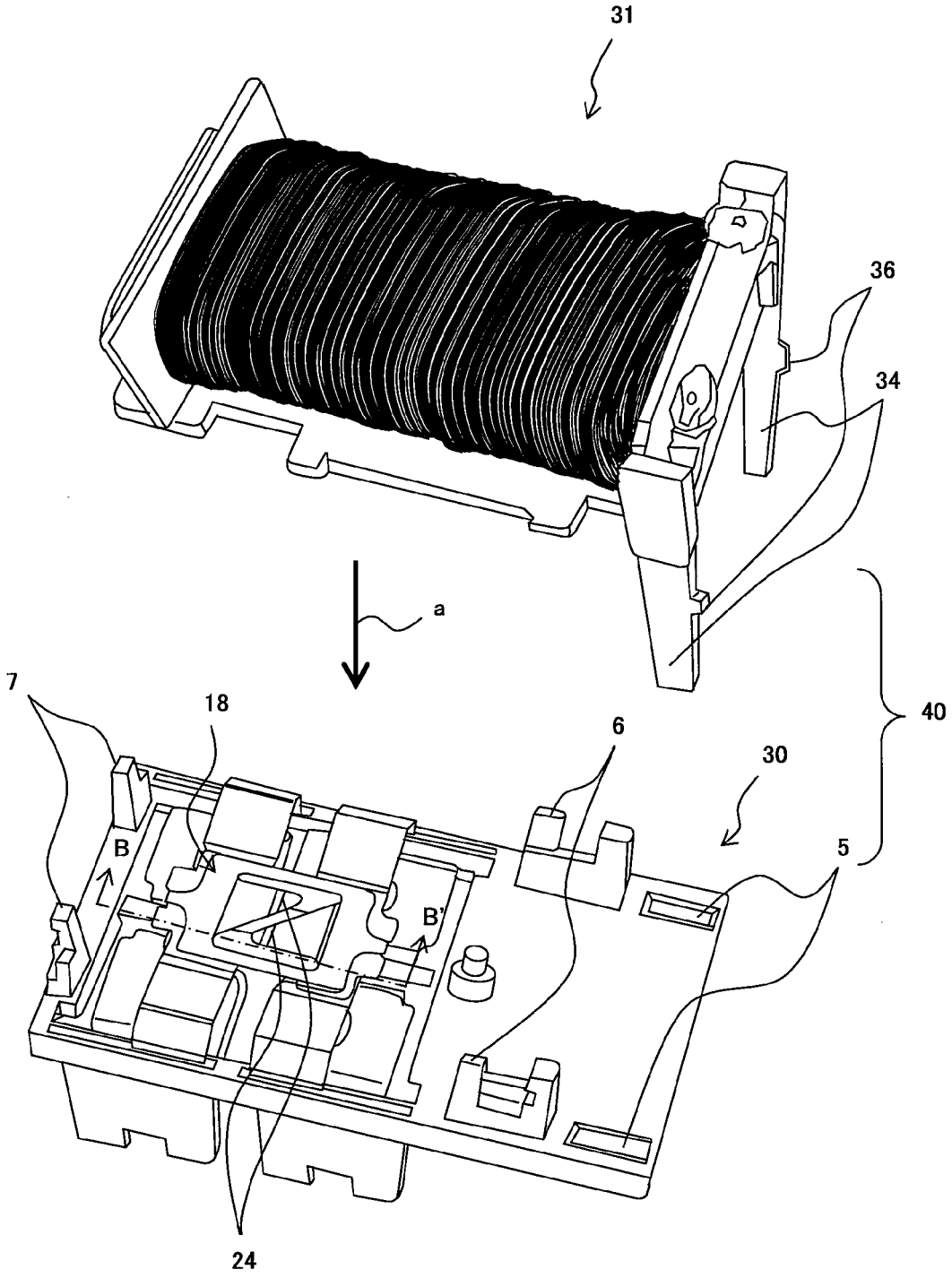
FIG. 5 shows the assembly of the electro-magnetic drive block into the contact block in the first preferred embodiment.

FIG. 5 shows the assembly of the electro-magnetic drive block 31 into the contact block 30. The electro-magnetic drive block 31 shown in the upper section of FIG. 5 is assembled into the contact block 30 as shown by an arrow mark in FIG. 5.

In this assembly, the joint of the yoke 37 of the electro-magnetic drive block 31 is fit into the yoke back fitting guide 6 and the yoke front fitting unit 7 and the electro-magnetic drive block 31 is supported by the contact block 30. Simultaneously, the coil terminal 34 of the electro-magnetic drive block 31 is inserted through the coil terminal through hole 5 of the contact block 30.

Then, the somewhat elastic coil terminal 34 is pressed into the inside while sliding its convexity 36 through the coil terminal through hole 5. After the convexity 36 passes through the coil terminal through hole 5, the convexity 36 pressed into the inside springs back outside by the elasticity of the coil terminal 34.

Then, the convexity 36 collides with and touches the bottom of the outer fringe of the coil terminal through hole 5. Thus, the electro-magnetic drive block 31 can be prevented from being dropped from the contact block 30. Thus, the assembly of the electro-magnetic drive block 31 into the contact block is completed and the electro-magnetic relay 40 in the first preferred embodiment of the present invention is completed.

Figure 6A:
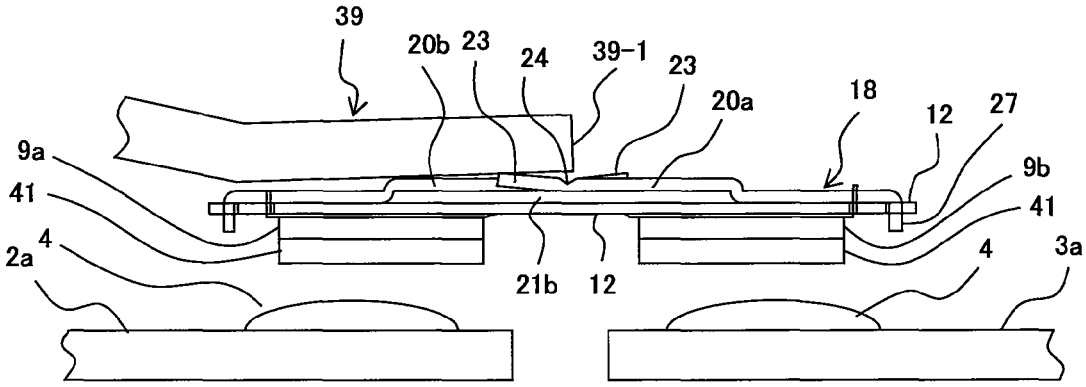
FIG. 6A is the enlarged B-B' cross section view of FIG. 5 shown in order to explain the operation of the completed electro-magnetic relay in the first preferred embodiment (No. 1).
Figure 6B:
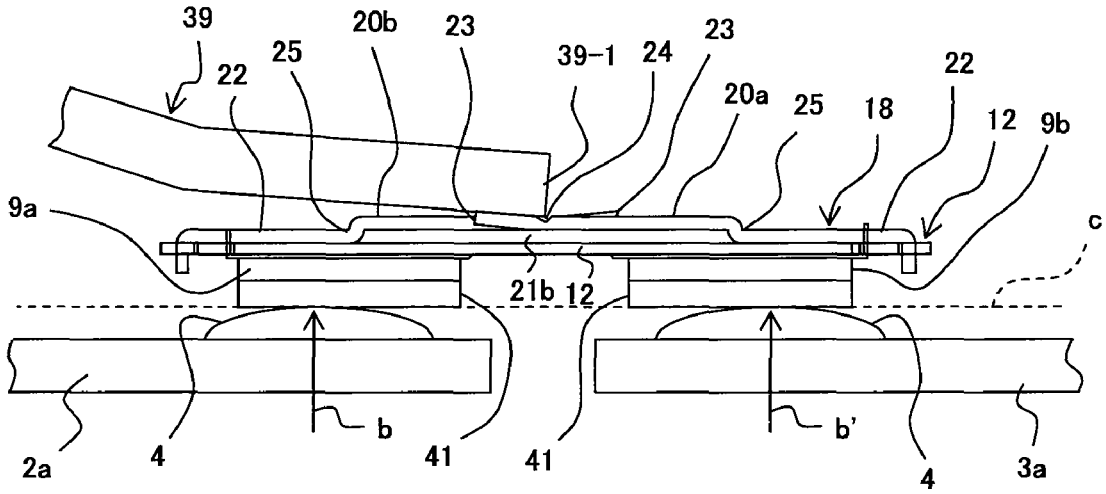
FIG. 6B is the enlarged B-B' cross section view of FIG. 5 shown in order to explain the operation of the completed electro-magnetic relay in the first preferred embodiment (No. 2).
Figure 6C:
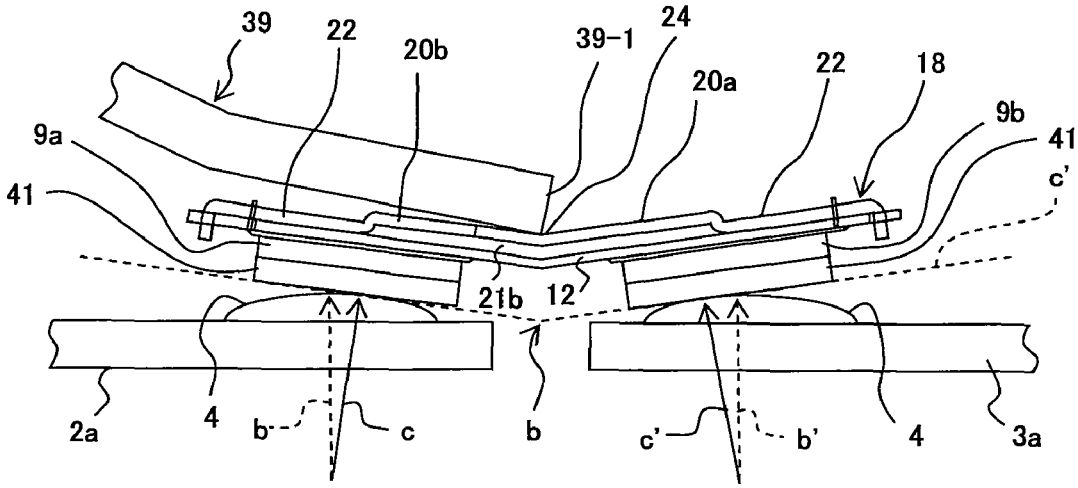
FIG. 6C is the enlarged B-B' cross section view of FIG. 5 shown in order to explain the operation of the completed electro-magnetic relay in the first preferred embodiment (No. 3).

FIGS. 6A~6C explain the operation of the completed electro-magnetic relay completed above and is the enlarged B-B' cross section view of the electro-magnetic relay 40 shown in FIG. 5. In FIGS. 6A~6C, the same numbers as those shown in FIGS. 1 through 5 are attached to the same components as those shown in FIGS. 1 through 5.

FIG. 6A shows the state where the energization into the electro-magnetic drive block 31 shown in FIG. 5 is not cut, therefore, the coil 33 forms no magnetic field, the iron core in the coil generates no magnetic force, the vertical drive unit 39-1 of the armature 39 is drawn toward the bottom surface of the yoke 37 by the adhesion force of the hinge spring 38, no contacts are driven and the contacts are open.

In this case, if the energization into the electro-magnetic drive block 31 is started, the coil 33 forms a magnetic field, the iron core in the coil generates magnetic force, the absorption/separation unit 39-2 of the armature 39 shown in FIG. 4B is absorbed to the iron core, the armature 39 rotates with the hinge as the fulcrum against the adhesion force of the hinge spring 38 and the vertical drive unit 39-1 separates from the bottom surface of the yoke 37 and rotates downward.

FIG. 6B shows the state immediately after the vertical drive unit 39-1 which rotates downward of the armature presses and drives the movable springs 9*a* and 9*b* via each tip 23 of the pair of tongues 20 of the press spring 18, the root 25 of the tongues 20, the longitudinal both ends 22 and the insulation sheet 12, thus the movable contacts 41 and the fixed contacts 4 are touched to close the contact circuit.

In this way, in FIG. 6B, since the contact support unit of the movable springs 9*a* and 9*b* is vertically lowered by the initial press of the vertical drive unit 39-1 and the movable contacts 41 and the fixed contacts 4 are touched immediately before, the contact surface of the plane movable contacts 41 are horizontal along a horizontal plane "c", thus, the movable contacts 41 touches the peak position indicated arrows "b" and "b'" of the surface-curved fixed contacts 4.

In succession, the tips of the tongues 20 are further pressed from above by the vertical drive unit 39-1. Then, as described with reference to FIG. 2B, the tongues 20 inclines downward with its tips downward, along with the inclination the longitudinal both ends 22 incline with the outside upward and the both-end joints 21 deflects in an upward concave shape.

At this moment, the longitudinal both ends 22 of the press spring 18 are transformed in parallel with the above-inclination and is taken in inside while increasing the inclination.

FIG. 6C shows that state. In FIG. 6C, since it is a cross section view, the both-end joint 21*b* is shown. However, the both-end joint 21*a* is the same as it.

As shown in FIG. 6C, along with such a transformation of being taken in inside the longitudinal both ends 22 of the press spring 18, each of the two movable springs 9*a* and 9*b* transforms and is taken in inside while forming an inclination falling inside the short side. Along with this transformation of the movable springs 9*a* and 9*b*, the four movable contacts 41 is also taken in inside while inclining.

The horizontal plane "c" long the plane of the movable contacts 41 shown in FIG. 6B transforms into a broken line "c'" having a shallow V-character shaped inclination which sinks most in the middle indicated by an arrow mark "b" of the two movable springs 9*a* and 9*b*, as shown in FIG. 6C.

Following the transformation of being taken in inside of the movable contacts 41 while changing the contact position with the fixed contacts 4 from a horizontal state to an inclined state, caused along with such an inclination falling inside the short side of the two movable springs 9*a* and 9*b*, the movable contacts 41 moves from the peak position indicated by an arrow "b" or "b'" of the fixed contacts toward the inside position of the two movable springs 9*a* and 9*b*, indicated by an arrow mark "c" or "c'" while sliding. Thus, a wiping operation is performed.

Generally, the surface of not only a contact but also a usual metal is easy to form a film by oxidation. An oxidized film has a function to reduce conductivity and also fine dust easily attaches to a contact. Such dust also reduces the conductivity of a contact by weakening the contact pressure between contacts.

In order to maintain such contact stability in the opening/closing of a contact with a low load, sometimes it becomes important to remove an oxidized film and dust by a wiping operation in the contact part of a contact surface. In this preferred embodiment, as described above, by the two movable springs 9*a* and 9*b* provided in parallel moving to incline inside every time a contact is closed, the contacts of the two circuits are wiped.

As described above, according to the electro-magnetic rely 40 in this preferred embodiment, by the armature 39 pressing the middle of four sets of bi-polar contacts (movable contact 41 and fixed contact 4) via the tip 23 of the pair of tongues 20 of the press spring 18, the relay operation of the two circuits can be set.

Then, by generating deflection between the movable contact mounting unit and terminal support unit of the movable springs 9 by pressing in the armature 39 after the fixed contacts 4 and the movable contacts 41 are collided and touched and inclining each of the two movable springs 9*a* and 9*b* downward inside the short side (toward the opposite party), the contacts moves from the peak position of the contact contact part of the two circuits toward the inside position of the movable springs 9*a* and 9*b* while sliding. Thus, the contacts of the two circuits are wiped.

However, traditionally, for the center to the circumference of the press spring directly pressed and driven by the armature, a series of incorporated press member is used, and by the armature pressing one point of the center, the press pressure is distributed to the circumference to touch the two sets of four contacts.

In this preferred embodiment, as described above, it is structured in such a way that a Z-character shaped cut can be provided at the center of the press spring to form a pair of tongues from the longitudinal both ends of the press spring toward the center and the tip of these tongues can press the tip of the armature.

Specifically, the press pressure of the armature individually but symmetrically acts on the movable spring of each of two pairs of contact circuit symmetrically positioned. Namely, although the tip of the armature presses and drives the tip of each different tongue of the press spring, these are symmetrically structured. Therefore, the press pressure of the armature can uniformly act on each contact circuit via the tongue.

Since the armature individually presses the pair of tongues, the balance of the press pressure of the armature conveyed to the circumference of the press spring is not easily broken, force is uniformly distributed and the contact pressure and resistance of two pairs of circuits can be uniformly maintained.

Furthermore, as to the positional relationship between the tip of the armature and the press spring, the same concavity in an opposite shape as the press/drive unit of the armature is provided in a part with which the armature collides and which receives press pressure from the armature, of the tip of the tongue of the press spring in such a way that the armature operation accompanying the coil energization of the electro-magnetic block may cause no positional deviation between them to guide the reception of the tip of the armature.

Thus, even if a positional deviation occurs between them due to the disposition error when assembling the armature between the press spring and the insulation sheet, the force distribution state never changes since the armature always catches the middle of the press spring and operates.

In the contact structure, the movable contact can also be mounted on, for example, a copper plate thicker than the movable spring in order to obtain low resistance. The copper plate can be, for example, 0.5 mm~0.8 mm thick.

Thus, resistance can be more easily reduced than using a movable spring whose thickness may be restricted depending on desired elasticity. In this case, for the movable plate an inlay material (material obtained by cementing two types of materials) of the contact material and copper can be also used and incorporated with the contact. For the movable spring stainless whose resistance is high can be also used.

Even when using a thick movable plate as described above, the structure in which an armature touches and drives the contacts of two circuits using the insulation sheet 12 and press spring 18 of the present invention can also have a contact wiping function as described with reference to FIG. 6C, by providing a pair of fixed contacts disposed on a straight line and two sets of movable springs for supporting a movable plate mounting movable contacts corresponding to the fixed contacts and bridging and mounting the insulation sheet 12 and the press spring 18 over these.

What is claimed is:

1. An electro-magnetic relay, comprising:

an electro-magnetic drive block comprising at least a coil, an iron core, a yoke and an armature;

a contact block comprising a base, two sets of a pair of terminals provided in parallel, corresponding to two circuits fixed on the base, spherical fixed contacts provided at one end of the terminals, two both-end-supported movable springs and plane movable contacts disposed in positions corresponding to the fixed contacts provided on the movable springs;

an insulation sheet disposed on the top surface of the two movable springs; and a press spring disposed on the top surface of the insulation sheet, each of the longitudinal both-ends of which is disposed on the top surface of the two movable springs, the center of which is cut in the shape of a character Z to form a pair of tongues and each tip of the pair of tongues of which is disposed in the middle of the two movable springs, wherein, the armature can drive the movable springs via the tip of the pair of tongues of the press spring, the root of the tongues, the longitudinal both-ends of the press spring and the insulation sheet to open/close the contact circuit of the two circuits, wherein, the press spring comprises a both-side joint the width of which is narrower than that of the tongues at an end in the further outside than the tongues in the sort side direction, wherein, when the armature pressed the tongues to touch the movable contacts on the fixed contacts, the both-side joint of the press spring bends in an upward concave shape, each of the longitudinal both-end sides of the press spring forms inclination from outside to inside, each of the two movable springs forms inclination downward the inside in the short side direction along the inclination of the longitudinal both-ends of the press spring and the movable contacts move toward the inside position of the two movable springs from the peak position of the spherical surface of the fixed contacts along the inclination downward the inside in the short side direction of the two movable springs.

2. The electro-magnetic relay according to claim 1, wherein a guide concavity in such a shape as to receive a tip of the armature when the tip of the armature moves to drive the movable springs is formed at the tip of the tongues of the press spring.

3. An electro-magnetic relay, comprising:

an electro-magnetic drive block comprising at least a coil, an iron core, a yoke and an armature;

a contact block comprising a base, two sets of a pair of terminals provided in parallel, corresponding to two circuits fixed on the base, spherical fixed contacts provided at one end of the terminals, two both-end-supported movable springs and plane movable contacts disposed in positions corresponding to the fixed contacts provided on the movable springs;

an insulation sheet disposed on the top surface of the two movable springs; and a press spring disposed on the top surface of the insulation sheet, each of the longitudinal both-ends of which is disposed on the top surface of the two movable springs, the center of which is cut in the shape of a character Z to form a pair of tongues and each tip of the pair of tongues of which is disposed in the middle of the two movable springs, wherein, the armature can drive the movable springs via the tip of the pair of tongues of the press spring, the root of the tongues, the longitudinal both-ends of the press spring and the insulation sheet to open/close the contact circuit of the two circuits, wherein the insulation sheet comprises a plurality of long cuts in a direction orthogonal to the longitudinal direction of the two movable springs, wherein, of the plurality of cuts, two cuts are provided in a position corresponding to the both-side joint of the press spring, the tongues of the press spring are formed in a position one step higher than the both-side joint by an upward crank curve formed on the root and when the press spring is disposed on the top surface of the insulation sheet, such space sufficient as to prevent the press spring from being interfered by the insulation sheet is formed.

4. The electro-magnetic relay according to claim 1, wherein the longitudinal both-ends of the insulation sheet are formed at least longer in the inside than the root of the tongues of the press spring and longer in the outside than the longitudinal both-ends of the press spring.

* * * * *